US005551338A

United States Patent [19]

Wall et al.

[11] Patent Number: 5,551,338

[45] Date of Patent: Sep. 3, 1996

[54] DRIVE DISENGAGING DEVICE FOR AN OFFSET LITHOGRAPHIC SEAL-TYPE DAMPENING SYSTEM

[75] Inventors: Robert Wall, Prospect Park; James W. Jakobsen, Bergenfield, both of N.J.

[73] Assignee: Varn Products Company, Inc., Oakland, N.J.

[21] Appl. No.: 432,317

[22] Filed: May 1, 1995

[51] Int. Cl.[6] ..... B41F 7/26; B41F 7/40

[52] U.S. Cl. ..... 101/148

[58] Field of Search ..... 101/148, 147, 101/350, 363, 349, 207–210, 351, 352, 355, 356, 357, 358, 360–362

[56] References Cited

U.S. PATENT DOCUMENTS

| | | | |
|---|---|---|---|
| 3,769,909 | 11/1973 | Fugman | 101/148 |
| 4,127,067 | 11/1978 | Dahlgren et al. | 101/148 X |
| 4,553,652 | 11/1985 | Fallos | 192/18 R |
| 4,796,737 | 1/1989 | Tyler | 192/18 R |

*Primary Examiner*—J. Reed Fisher
*Attorney, Agent, or Firm*—James W. Jakobsen

[57] ABSTRACT

A drive disengaging device for a seal-type dampening system in an offset lithographic printing press. The disengaging mechanism includes a clutch gear rotationally mounted on a drive shaft and having a clutch bearing securely mounted thereto. The drive shaft incorporates a specified diameter, on which the clutch bearing functions as designed, and a stepped diameter, on which the clutch bearing does not function as designed. Alternate axial positioning of the clutch bearing between the specified diameter and the stepped diameter causes the clutch bearing to function or not function, respectively, as designed. Gear mesh between the clutch gear and the press drive train is maintained when the clutch gear is in either position. Axial positioning of the gear clutch assembly is controlled by the press operator through an actuator assembly. The actuator assembly can be either an axial-type or rotation-type, depending on the press configuration and space restrictions.

18 Claims, 4 Drawing Sheets

DRIVE DISENGAGING DEVICE FOR AN OFFSET LITHOGRAPHIC SEAL-TYPE DAMPENING SYSTEM

BACKGROUND OF THE INVENTION

1. Field of the Invention

The present invention relates generally to lithographic printing presses and more particularly it concerns a device for disengaging the drive gearing of a seal-type dampener from the drive train of an offset lithographic printing press.

2. Description of the Prior Art

In the sheet-fed printing industry there are two basic classes of dampeners in use today. They are ductor-type dampeners and continuous-type dampeners.

Ductor-type dampener systems, although still sometimes sold by press manufacturers, are all but obsolete. This is because of the systems' inability to provide an even supply of dampening solution to the printing plate, thereby leading to poor ink-water balance.

Continuous-type dampener systems, in contrast, have become the preferred method of plate dampening because of their superior ability to evenly feed fountain solution to the plate, and thereby provide much improved ink-water balance. Continuous-type systems can be broken down into two species. They are the pan-fed-type continuous dampener systems (hereinafter described as pan-type dampeners) and the nip-fed/seal-type continuous dampener systems (hereinafter described as seal-type dampeners).

Of the pan-type dampeners there are essentially three sub-species: non-integrated, fully integrated, and partially integrated. The difference between these three sub-species depends on whether the pan-type dampener is tied only to the press's plate cylinder, tied only to the press's first ink form roller, or tied to both the press's plate cylinder and first ink form roller, respectively. All three types function essentially the same, though, can vary in complexity depending on the mechanism used to operate the configuration. Examples of pan-type dampener systems are seen in the prior art dampening systems of Dahlgren, U.S. Pat. No. 3,168,037, and MacConnell et al., U.S. Pat. No. 5,158,017. Characteristics common to the pan-type dampener species are a pan roller dipping into a fountain solution pan; a variable speed motor for driving the pan roller at speeds less than that of the plate cylinder; a metering roller in contact with the pan roller; at least one rubber coated form roller in contact with the printing plate and/or a bridging roller in contact with the first ink form roller, depending on whether the dampener is integrated or not; and one to several transfer rollers between the form and/or the bridging roller and metering roller to mill and transfer the fountain solution.

There are few variations between seal-type dampeners. Several examples of seal-type dampeners are seen in the prior art dampening systems of Fugman et al., U.S. Pat. No. 3,769,909, and Laudon, U.S. Pat. No. 4,455,938. Characteristics common to the seal-type dampeners are a hard metering roller, a rubber form roller in contact with the hard metering roller and in contact with the printing plate, seals enclosing the ends of the V-shaped nip formed between the metering and form rollers, a fountain solution feed system feeding solution to the V-shaped nip, and a press driven dampener drive gear attached to and driving either the form roller or metering roller. A variation of the typical seal-type dampener can be seen in the prior art dampening system of Hayes et al., U.S. Pat. No. 5,134,935. In this invention the dampener is similar to that of the Fugman et al. and Laudon patents excepting the fountain solution is pulled from a pan by the metering roller.

Until recently, the majority of large sheetfed press manufacturers offered either a ductor-type system of their own design, a pan-type continuous dampener system of their own design, or a pan-type continuous dampener system designed by a third-party vendor. Most customers choose to purchase one of the pan-type dampener designs over the ductor-type system. Nowadays, however, more and more manufacturers are offering, and customers are purchasing, the seal-type dampener system because they are beginning to recognize the benefits that the system has over the pan-fed dampener design. The benefits become apparent when the two systems are compared side-by-side.

The pan-type continuous dampener system requires at least three, but more often has four or five, rollers in the roller train. Each of these rollers must be cleaned between color changes and at the end of the workday, periodically adjusted to each other and maintained, and, when worn out or damaged, replaced. Since the seal-type dampener requires only two rollers to operate properly, roller cleaning, periodic adjustment and maintenance, and replacement is relatively much easier to carry out and much less costly.

In addition, pan-fed dampener systems use a motor and complex controlling electronics to drive the pan roller. The initial cost and maintenance of this equipment is extremely high. Because the seal-type dampening system does not require a motor, but is instead gear driven by the press gear train, the additional costs do not exist.

And, in spite of the more apparently sophisticated design of the pan-fed systems, they require a skilled operator to rim. In contrast, the seal-type system requires little operator attention during printing leaving more time to deal with other aspects of the printing operation.

Finally, because pan-fed systems usually require a percentage of alcohol in the fountain solution to ensure optimum fluid control, a fountain solution recirculator system is usually a necessary attachment to chill and maintain the alcohol concentration. These recirculators add considerable cost to the purchase and maintenance of the dampener systems. The seal-type system, on the other hand, does not require alcohol, therefore a recirculator system is unnecessary.

In sum, the pan-fed dampener system, when compared to the seal-type dampening system, initially costs more to purchase, requires a more skillful press operator to run, takes more effort to maintain, and costs more to repair.

But, seal-type systems have one notable disadvantage when compared to pan-fed systems: the inherent inability to disengage the dampener unit from the press drive train when the dampener is not needed for printing. This fact only became apparent recently because it was only until a short while ago that seal-type dampener systems started to be used on multi-head presses. Previously, the systems were found only on single-head duplicators (generally defined as presses having only one printing head and a plate width approximately less than or equal to 18 inches). Now, because of its emerging popularity on medium to larger sheet size multi-head presses, this limitation has come to light.

There are several reasons printers will not use one or several heads of their multi-head press. The most obvious is that the job being run requires less colors than the number of color heads on the press.

Unlike the seal-type system, the pan-fed system can be easily turned off by deenergizing the pan-roller motor and withdrawing the typically friction driven form roller from the press's plate cylinder and/or, if partially or fully integrated, the bridging roller from the press's first ink form roller.

Because seal-type systems are directly driven by the press's gear train, the press operator cannot turn the system off and has the option of either leaving the seals in and allowing the unit rollers and seals to run dry during printing, thereby causing premature wear of the rollers and seals; removing the seals and allowing the unit rollers to run dry during printing, thereby subjecting the rollers to premature wear; or leaving the seals in and filling the nip with water during printing, thereby reducing, though not eliminating, wear on the rollers and seals. All three options required extra effort by the operator and even the least harmful to the unit, adding water to the nip, does not completely eliminate unwanted wear and tear to the dampener. Said wear inevitably requires the press owner to pay higher maintenance costs in the form of early seal and roller replacement.

SUMMARY OF THE INVENTION

The disclosed invention provides a combination that will disengage a seal-type dampening system from the press drive train while maintaining a constant gear mesh in the drive gearing. Gear disengagement occurs between a clutch bearing and a drive shaft having specified diameter and stepped diameter. The clutch bearing is securely fastened to the inside diameter of a clutch gear which meshes with the press gear train. Gear disengagement is controlled by the press operator through an adjustable actuator mechanism. The actuator mechanism can shift the clutch bearing and gear so that the clutch bearing moves from its functional position over the specified diameter to its non-functional position over the stepped diameter. Said mechanism can be either a push-type or rotation-type actuator. The actuator mechanism utilized depends on the press configuration and space restrictions. Several objects are achieved by the disclosed improvement, a number of which are described below.

A first object of the present invention is to provide a device for disengaging the drive of a seal-type dampening system in an offset lithographic printing press.

Another object of the invention is to enable the press operator to disengage the seal-type dampeners on a multi-head press for printing operations requiring less than all of the color heads of the press.

A further object of the present invention is to prolong the life of the seal-type dampener gears, bearings, and in particular, the rollers and seals.

It is still another object of the invention to provide a gear disengaging device of relative simple and economic design.

Another object of the present invention is to provide a gear disengaging device that cannot be operated while the printing press is rotating, thereby eliminating the possibility that the mechanism can be damaged by shock loads.

A further object is to reduce the time and effort the press operator expends to operate a press having a seal-type dampening system by eliminating the need for either removing the seals or filling the nip with water on a multi-head press during printing operations requiring less than all of the color heads of the press. Also, to eliminate the need for the press operator to either replace the seals or empty the nip of water when the printing operations are completed.

The foregoing and other objects, features, and advantages of the present invention will be apparent to those skilled in the art in light of the following description of preferred embodiments and the accompanying figures.

DETAILED DESCRIPTION OF THE INVENTION

The preferred embodiments of the present invention will be described with reference to the accompanying figures.

Figure 1:
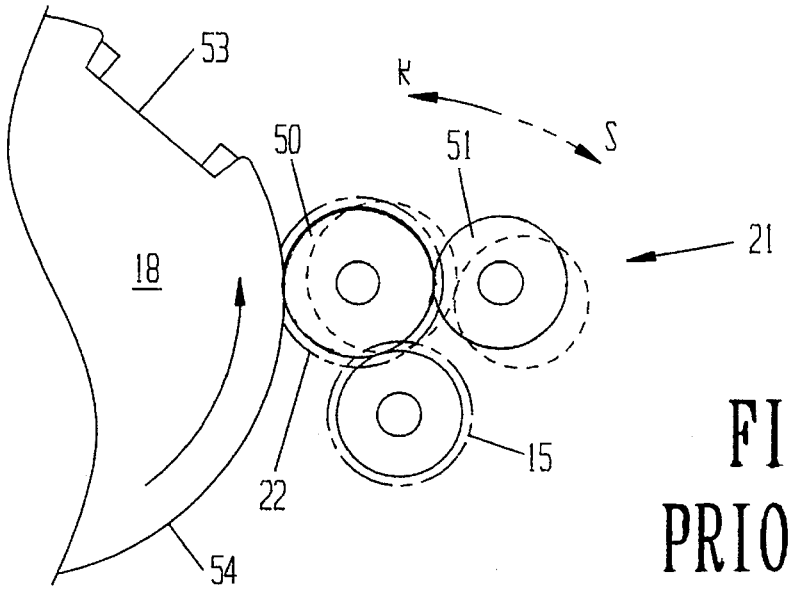
FIG.1 PRIOR ART
FIG. 1 is a side elevation view of a prior art seal-type continuous dampening system showing its relationship to the plate cylinder and drive gear in the on and off position.

FIG. 1 illustrates a prior art seal-type dampening system generally at 21. The basic system is made up of a rubber form roller 50 in pressing engagement with a metering roller 51. Prior to printing, the two rollers are rotated counter-clockwise, as represented by arrow R, around a drive gear 15 causing the form roller 50 to be pressed against, and transfer fountain solution to, a printing plate 54 attached to the periphery of a plate cylinder 18. This relationship is maintained throughout the printing operation. Drive gear 15 maintains the surface speed of the dampener rollers through the plate cylinder gap 53 by driving a dampener drive gear 22 which is attached to the end of the form roller 50.

Certain versions of the seal-type dampener have the dampener drive gear 22 attached to the end of the metering roller 51. Operation of these metering roller driven seal-type dampeners is essentially the same as the form roller driven type.

When the press is not in operation or if the color head upon which that dampener serves is not required for the printing job, the seal-type dampener 21 (here shown in dotted lines) is rotated in the clockwise direction, as represented by arrow S, around the drive gear 15 causing the form roller to pull away from the printing plate and plate cylinder 54,18.

Figure 2:
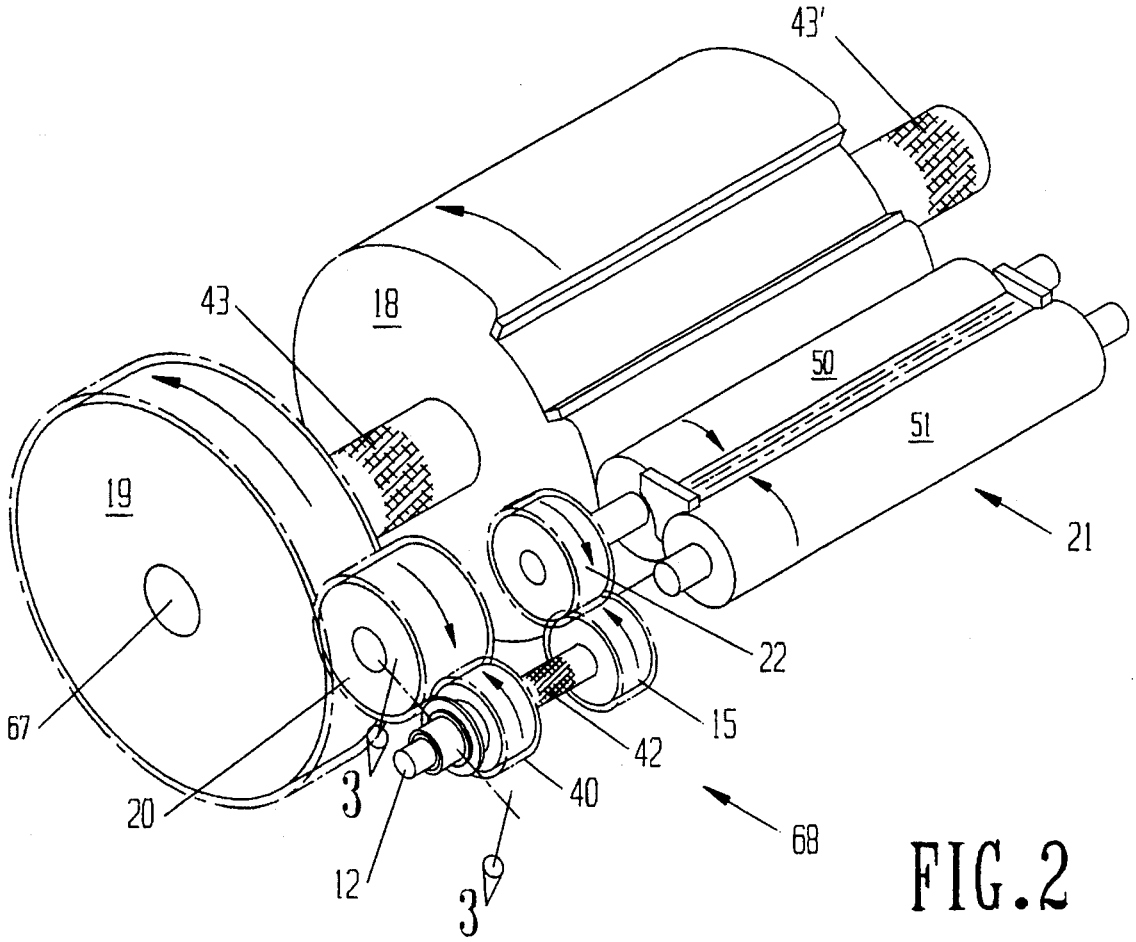
FIG. 2 is a perspective view showing the relationship between the gear clutch assembly of the present invention within a seal-type continuous dampening system drive train.

FIG. 2 is a perspective view showing the plate cylinder 18, the seal-type dampening system 21, and a gear train, shown generally at 68, through which the dampener is driven. The plate cylinder 18 is supported in the press sideframes (not shown) on bearing journals 43,43'. A plate cylinder gear 19 is attached to a plate cylinder shaft 67 and drives a press idler gear 20. Press idler gear 20 drives a gear clutch assembly 40 which transfers the drive power through a drive shaft 12 to the drive gear 15. The drive shaft 12 is supported with beatings (reference FIG. 5) in the sideframe on a drive shaft bearing area 42. As noted above, the drive gear 15 directly drives the dampener drive gear 22, which is attached to the dampener form roller 50 or metering roller 51, and thereby drives the dampener. The arrows across the outside diameters of the cylindrical surfaces indicate cylinder and gear rotation directions during printing.

Figure 3:
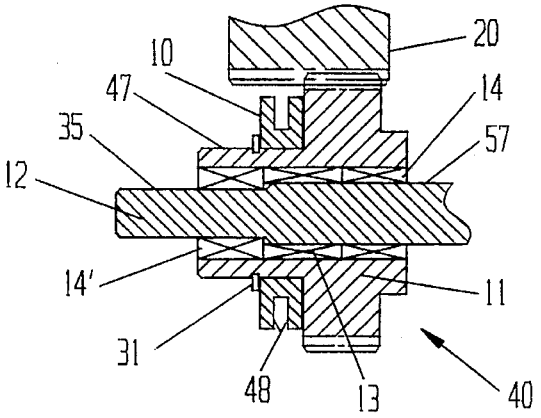
FIG. 3 is a section view taken along line 3—3 of FIG.2 showing the gear clutch assembly in the engaged position.
Figure 4:
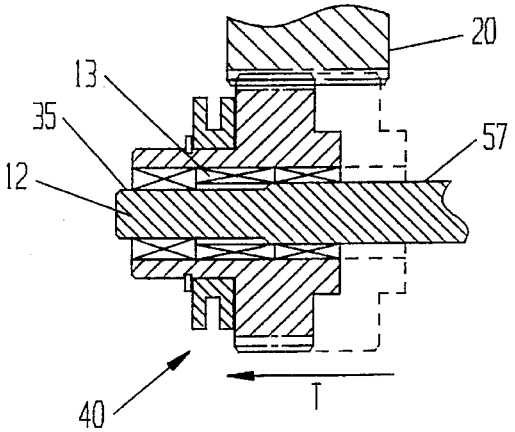
FIG. 4 is a section view similar to FIG.3 showing the gear clutch assembly in the disengaged position.

FIG. 3 and FIG. 4, sectional views taken along line 3—3 of FIG. 2, show the gear clutch assembly 40 in the on and off position, respectively. Referring to FIG. 3, first and second needle roller beatings 14,14' are pressed into and supporting a clutch gear 11 on the drive shaft 12. The needle roller beatings 14,14' can be readily replaced by bushings without affecting the operation of the combination. It is important to note that the second needle roller bearing 14' has a reduced inside diameter to match a stepped diameter 35 of the drive shaft 12. Interposed between the needle roller beatings 14,14' is a clutch bearing 13. The clutch bearing 13 is a type well known in the art. It functions as a bearing when rotated in one direction and locks onto the shaft when rotated in the opposite direction. The bearing aspect of the clutch bearing 13 is necessary for a seal-type dampener because if the dampener is rotated in the reverse direction the fountain solution will be pulled out of the nip and dump into the press. For the clutch bearing 13 to operate properly as both a bearing and a clutch the shaft upon which it is mounted must be a diameter as specified by the manufacturer (hereinafter described as the specified diameter 57). An example of one such bearing is INA Bearing Company, Inc.'s shell type roller clutch—series HF—described in their catalogue numbered PA-101.

In FIG. 3 the clutch bearing 13 can be seen riding on the specified diameter 57 of the drive shaft 12. In this position the clutch bearing 13 operates as a clutch when rotated in one direction and as a bearing when rotated in the opposite direction. Therefore, when the press idler gear 20 is rotated in a direction proper for locking the clutch bearing 13 onto the drive shaft 12, it will cause the drive shaft 12 to rotate. This will, consequently, rotate the drive gear 15, which will, in turn, rotate the dampener drive gear 22 and the seal type dampener 21 (reference FIG. 2). When the press idler gear 20 is rotated in the opposite direction the clutch bearing 13 will operate as a bearing and the drive shaft 12 will not rotate.

FIG. 4 shows the gear clutch assembly 40 shifted to the left (indicated by arrow T) into the off, or disengaged, position. In this position the clutch bearing 13 does not ride on the specified diameter 57 of the drive shaft 12 but instead is located above the stepped diameter 35 of the drive shaft 12. Because the clutch bearing 13 is not on the specified diameter 57 as required for it to work properly as a clutch beating, the drive shaft 12 will not rotate when the gear clutch assembly 40 is driven by the press idler gear 20.

Rotationally assembled onto a shoulder 47 of the clutch gear 11 and maintained in place by a retaining ring 31 is a fork guide 10. Said fork guide 10 cooperates with an actuator mechanism and fork 24 (reference FIG. 3 and FIG. 5) to maintain the clutch gear 11 in the on or off position. An advantage of using the fork guide 10 and not merely cutting the channeled shape directly into the clutch gear 11 is that if the guide faces 48 of the fork guide 10 become worn, only the fork guide 10 will have to be replaced and not the much more expensive clutch gear 11. In addition, fork guide 10 wear is kept to a minimum because the fork guide 10 acts as a bushing and will rotate on the clutch gear shoulder 47 should frictional forces be encounter between it and the fork 24. For the above reasons the fork guide should be made of a relatively soft material such as brass or bearing bronze.

Figure 5:
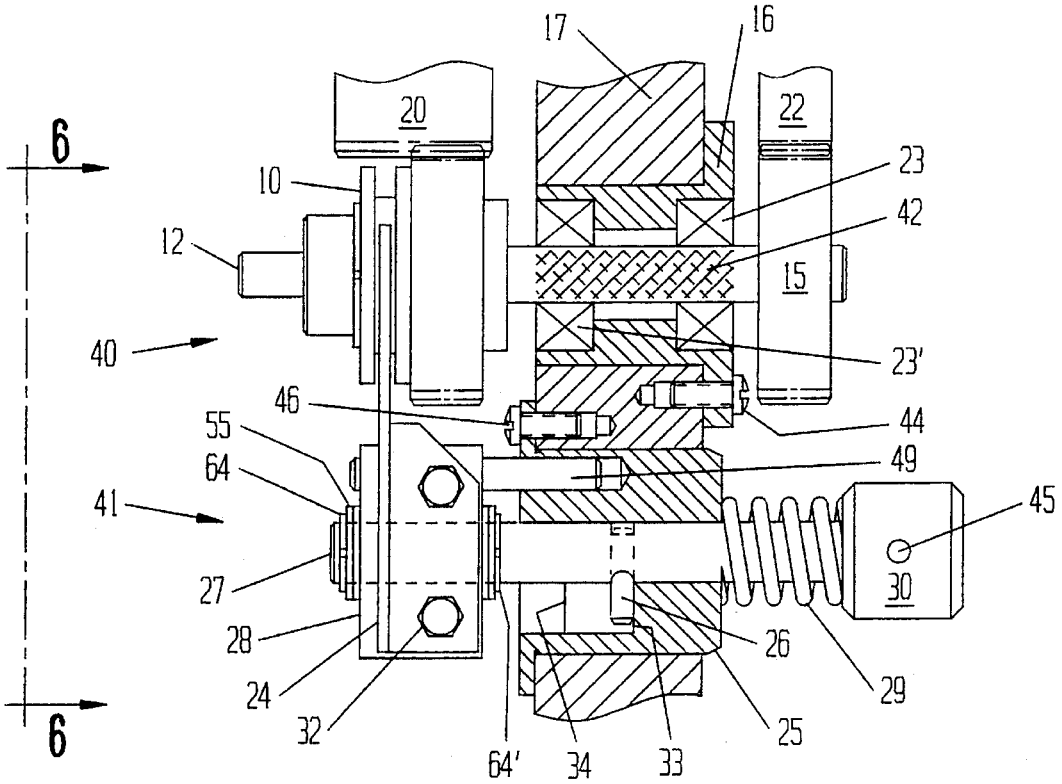
FIG. 5 is a partial section view similar to FIG. 3, however, in addition, showing how the gear clutch assembly, drive shaft, fork, and push-type actuator mechanism are assembled to the sideframe.

Referring now to FIG. 5, the drive shaft bearing area 42 of drive shaft 12 is press fit into ball bearings 23,23'. Said ball bearings 23,23' are mounted into a bearing housing 16 which is fit into a through hole in the press sideframe 17 and maintained in position by a fastener 44.

Also in FIG. 5 is a first embodiment of the actuator mechanism, generally at 41, and the fork 24. This axial-type actuator mechanism 41 includes an axial-type shaft guide 25 which is fit into a through-hole in the press sideframe 17 and maintained in position by a fastener 46. Slideably and rotatably extending through the shaft guide 25 is an axial-type actuator shaft 27. The actuator shaft 27 has a handle 30 fixed to one end with a spring pin 45.

The axial-type actuator shaft 27 is adjustable to two positions. A first position, shown in FIG. 5, corresponds to the on, or drive, position of the gear clutch assembly 40 as described hereinbefore and shown in FIG. 3. In this position a pin 26, fixedly pressed into the actuator shaft 27, resides on a recessed shoulder 33 of the shaft guide 25. A shaft spring 29 is interposed between the shaft guide 25 and handle 30, maintaining the pin 26 on the recessed shoulder 33.

A second position, not shown in FIG. 5, corresponds to the off, or disengaged, position of the gear clutch assembly 40 as described hereinbefore and shown in FIG. 4. This position is attained by the press operator depressing the handle 30 against the bias of the shaft spring 29 and then rotating the handle 30 to cause the pin 26 to rest on a stepped shoulder 34 of the shaft guide 25. Axial movement of the pin 26 from the recessed shoulder 33 to the stepped shoulder 34 is equal to the width of the clutch bearing 13, thereby causing the clutch bearing 13 to move its full width when the actuator mechanism is operated (reference FIG. 3 and FIG. 4).

Figure 6:
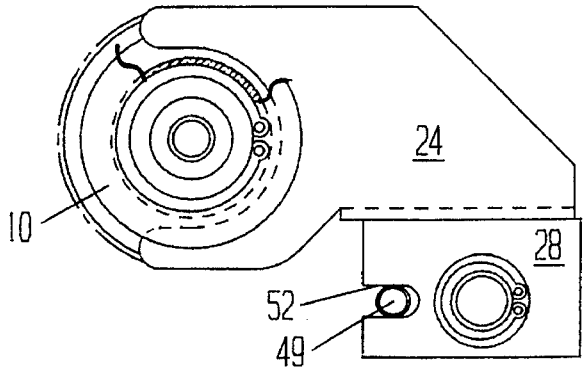
FIG. 6 is a partial section side elevation view taken along the line 6—6 of FIG. 5 showing the guide pin location and the clearance relationship that is maintained between the fork and fork guide.

The axial-type actuator shaft 27 shifts and maintains the gear clutch assembly 40 in either the on or off position through an axial-type guide block 28 and the fork 24. The guide block 28 is rotationally mounted on the actuator shaft 27 and maintained in position by retaining tings 64,64'. Shims 55 are located between the guide block 28 and each retaining ring 64,64' to allow axial adjustment between the gear clutch assembly 40 and the drive shaft 12. The fork 24 is attached to the guide block 28 by fasteners 32 and rides between the guide faces 48 (reference FIG. 3) of the fork guide 10. A guide pin 49 may be provided to retain the fork 24 in alignment with the fork guide 10. The guide pin 49 is pressed into a hole in the shaft guide 25. FIG. 6, a partial section side elevation view taken along the line 6—6 of FIG. 5, depicts the guide pin 49 located in a cutout 52 in the guide block 28, thereby fixing a clearance relationship between the fork 24 and fork guide 10.

Figure 7:
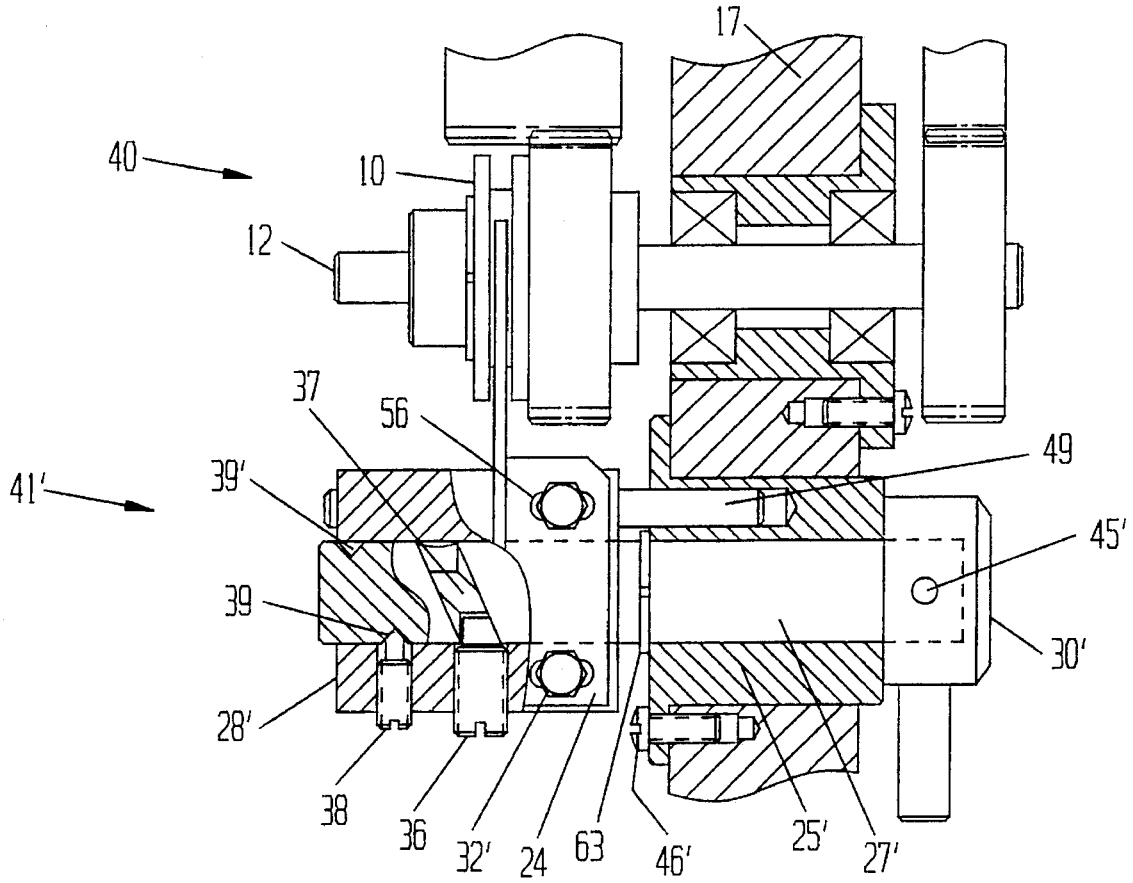
FIG. 7 is a partial section view similar to FIG. 5, however, instead of the push-type actuator mechanism, the alternate embodiment rotation-type actuator mechanism is shown.

FIG. 7 shows, generally at 41', a second embodiment of the actuator mechanism. This rotation-type actuator mechanism 41' includes a rotation-type shaft guide 25' which is fit into a through hole in the press sideframe 17 and maintained in position by a fastener 46'. Rotatably extending through the shaft guide 25' is a rotation-type actuator shaft 27'. The actuator shaft 27' is prevented from moving axially by a retaining ting 63 and a handle 30'. Said handle 30' is fixed to the shaft 27' with a spring pin 45'. Rotatably and slideably located about the other end of the actuator shaft 27' is a rotation-type guide block 28'. The fork 24 is secured to the guide block 28' with fasteners 32'. The fork 24 and rotation-type guide block 28' function with the fork guide 10 and gear clutch assembly 40 in a manner similar to the fork 24 and axial-type guide block 28 of the first embodiment (hereinbefore described and depicted in FIG. 5). Elongated holes 56 may be provided in the fork 24 for adjusting the gear clutch assembly 40 to the drive shaft 12 when utilizing the rotational-type actuator mechanism 41'.

The axial movement of the guide block 28' in the rotation-type actuator mechanism 41' is caused by a full dog set screw 36 secured to the guide block 28' and riding in a helix grove 37 machined into the actuator shaft 27'. The throw of the guide block 28' is determined by the pitch of the helix groove 37. The pitch is equal to the width of the clutch bearing 13, thereby causing the clutch bearing 13 to move its full width when the actuator mechanism is operated (reference FIG. 3 and FIG. 4). A spring plunger 38 is secured to the guide block 28'. On and off actuator positions can be felt in the handle 30' when it is operated as the spring loaded finger of the spring plunger 38 falls into on 39 and off 39' detents in the actuator shaft 37'.

A guide pin 49 is provided to retain the fork 24 in alignment with the fork guide 10. The guide pin 49 is pressed into the rotation-type shaft guide 25'. The guide pin 49 is located in a cutout in the guide block in the same manner described above for the axial-type actuator mechanism 41 and depicted in FIG. 6.

Both the axial- and rotation-type actuator handles 30,30' are located in the vicinity of the dampening unit 21. Press manufacturers guard this area with an electrically interlocked safety guard (not shown). When the guard is opened the interlocking switch is activated and the press comes to a complete stop within seconds. This attribute also prevents the operator from operating the drive disengaging device while the press is rotating. Therefore, the shock that would occur to the clutch bearing 13 if it were to be engaged while the press was rotating is prevented.

Figure 8:
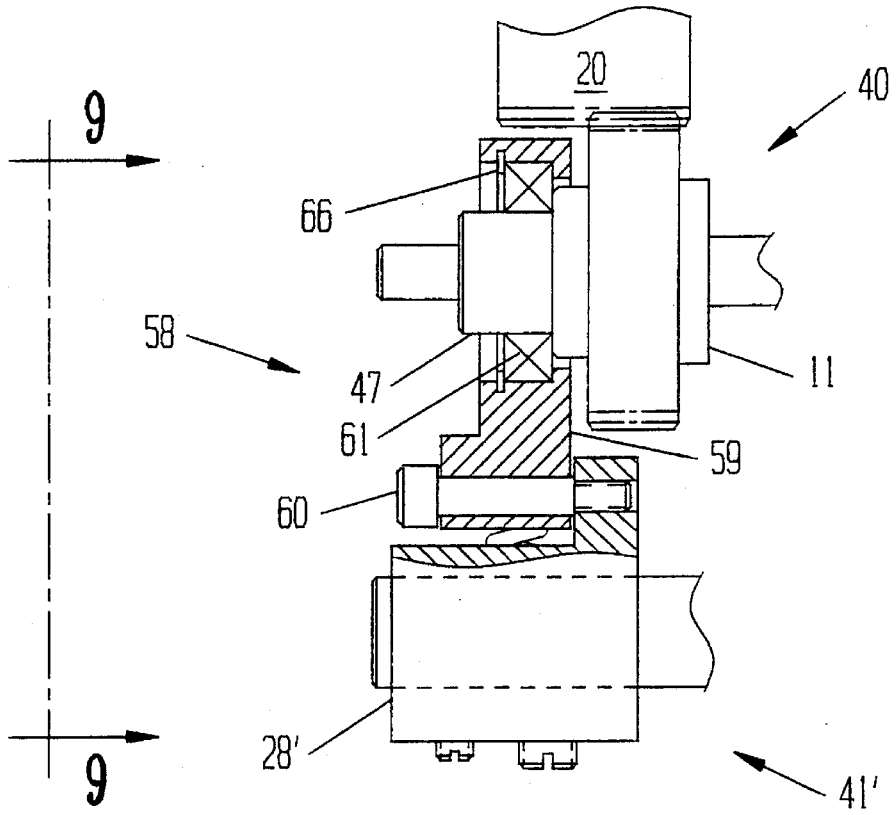
FIG. 8 is a partial section view similar to FIG. 7, however, in place of the fork guide and fork, the alternate embodiment gear positioning guide assembly is shown.

Referencing FIG. 8 there can be seen a third embodiment of the present invention. This embodiment utilizes the basic concepts of both the gear clutch assembly 40 and the rotation-type actuator assembly 41'. Altered, however, is the guiding mechanism described above. More specifically, the fork guide 10, fork 24, and guide pin 49 has been replaced by a gear positioning assembly, shown generally at 58. The positioning assembly 58 includes an arm 59 pivotally attached at one end to the rotation-type guide block 28' by a shoulder bolt 60. Received in the opposite end of the arm 59 is an arm bearing 61 trapped by a retaining ring 66. Said bearing is then pressed onto the clutch gear shoulder 47 of the clutch gear 11. Although the rotation-type actuator assembly 41' is shown working in conjunction with the arm 59 and its associated parts, it should be clear that the axial-type actuator assembly 41 would work equally well.

Figure 9:
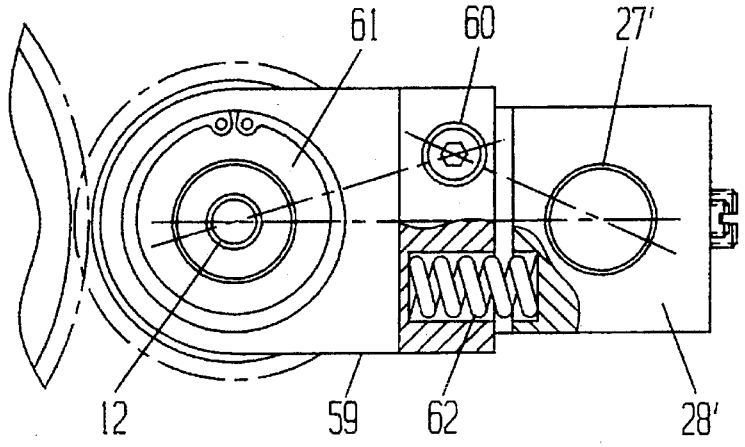
FIG. 9 is a partial section side elevation view of the gear positioning guide assembly taken along line 9—9 of FIG. 8.

FIG. 9, a partial section side elevation view taken along 9—9 of FIG. 8, depicts the arrangement used to compensate for center-to-center tolerance variations between the drive shaft 12 and the rotation-type actuator shaft 27'. Because the shoulder bolt 60 is not collinear with the drive shaft 12 and actuator shaft 27' (reference the phantom line triangle formed through these three points), the center distances between the arm bearing 61 and the through-hole in the rotation-type guide block 28' can be increased or decreased by pivoting the arm 59 clockwise or counterclockwise, respectively, around the shoulder bolt 60. A lightweight arm spring 62 provides bias between the arm 59 and guide block 28' to prevent vibration motion and take up play in the assembly.

While specific embodiments of the present invention have been shown and described, it should be apparent that many modifications can be made thereto without departing from the spirit and scope of the invention. Accordingly, the present invention is not limited by the foregoing description, but is only defined by the scope of the claims appended hereto.

I claim:

1. A drive disengaging device for disengaging a seal-type continuous dampening system from the drive train of an offset lithographic printing press; the seal-type dampener including at least two rollers, two seals enclosing the ends of the inward nip of two of the rollers, and a dampener drive gear; the printing press including a plate cylinder, press drive gears and a sideframe supporting the plate cylinder and the press drive gears; wherein the improvement comprises:

a drive shaft, having a first and second end, rotationally supported by the sideframe;

a clutch gear rotationally mounted on the first end of the drive shaft and meshing with at least one press drive gear;

a drive gear secured to the second end of the drive shaft and meshing with the dampener drive gear; and a means for engaging and disengaging the clutch gear from the drive shaft.

2. The drive disengaging device of claim 1 wherein the means for engaging and disengaging the clutch gear from the drive shaft comprises:

a specified diameter integrally a part of the outside diameter of the drive shaft;

a stepped diameter made integrally a part the endmost portion of the first end of the drive shaft;

a clutch bearing securely attached to the clutch gear; and a means for shifting the clutch gear such that the clutch bearing can be alternately located over the stepped diameter and the specified diameter.

3. The drive disengaging device of claim 2 wherein the means for shifting the clutch gear comprises:

an axial-type shaft guide mounted in the sideframe, said axial-type shaft guide having a recessed shoulder and stepped shoulder therein;

an axial-type actuator shaft rotationally and axially supported in the axial-type shaft guide;

a pin secured normal to the axis of the axial-type actuator shaft and located on the recessed shoulder when in a first position and located on the stepped shoulder when in a second position;

a means for biasing the axial-type actuator shaft and pin for maintaining the pin in the first or second position;

an axial-type guide block rotationally mounted on the axial-type actuator shaft; and a means for transferring the axial movement of the axial-type guide block to the clutch gear;

whereby alternate positioning of the axial-type actuator shaft causing the pin to alternately move from the first position to the second position will cause the clutch bearing to be alternately located over the specified diameter and the stepped diameter.

4. The drive disengaging device of claim 3 wherein the means for transferring the axial movement of the axial-type guide block to the clutch gear comprises a fork guide mounted on the clutch gear and a fork secured to the axial-type guide block and guidingly engaging the fork guide.

5. The drive disengaging device of claim 4 further comprising at least two parallel surfaces in the axial-type guide block defining a cutout and a guide pin secured to the axial-type shaft guide and slidingly engaging the parallel surfaces of the axial-type guide block.

6. The drive disengaging device of claim 3 wherein the means for transferring the axial movement of the axial-type guide block to the clutch gear comprises an arm pivotally attached to the axial-type guide block and an arm bearing mounted to the arm, said arm bearing being also attached to the clutch gear.

7. The drive disengaging device of claim 2 wherein the means for shifting the clutch gear comprises:

a rotation-type shaft guide mounted in the sideframe;

a rotation-type actuator shaft rotationally supported in the rotation-type shaft guide;

a rotation-type guide block rotationally and axially mounted on the rotation-type actuator shaft;

at least two parallel surfaces helically wound around and integrally a part of the rotation-type actuator shaft, said surfaces starting at a first position and ending at a second position;

a full dog set screw attached to the rotation-type guide block and engaging the parallel surfaces; and a means for transferring the axial movement of the rotation-type guide block to the clutch gear;

whereby alternate rotational movement of the rotation-type actuator shaft causing the full dog set screw to alternately move from the first position to the second position will cause the clutch bearing to be alternately located over the specified diameter and the stepped diameter.

8. The drive disengaging device of claim 7 wherein the means for transferring the axial movement of the rotation-type guide block to the clutch gear comprises a fork guide mounted on the clutch gear and a fork secured to the rotation-type guide block and guidingly engaging the fork guide.

9. The drive disengaging device of claim 8 further comprising at least two parallel surfaces in the rotation-type guide block defining a cutout and a guide pin secured to the rotation-type shaft guide and slidingly engaging the parallel surfaces of the rotation-type guide block.

10. The drive disengaging device of claim 7 wherein the means for transferring the axial movement of the rotation-type guide block to the clutch gear comprises an arm pivotally attached to the rotation-type guide block and an arm bearing mounted to the arm, said arm bearing being also attached to the clutch gear.

11. The drive disengaging device of claim 7 further comprising a spring plunger secured to the rotation-type guide block, said spring plunger including a spring loaded finger extending therefrom;

an on-detent and an off-detent made an integral part of the rotation-type actuator shaft and aligning with the spring plunger such that when the clutch bearing is located over the specified diameter the spring loaded finger falls into the on-detent and when the clutch bearing is located over the stepped diameter the spring loaded finger falls into the off-detent.

12. A drive disengaging device for disengaging a seal-type continuous dampening system from the drive train of an offset lithographic printing press; the seal-type dampener including at least two rollers, two seals enclosing the ends of the inward nip of two of the rollers, and a dampener drive gear; the printing press including a plate cylinder, press drive gears and a sideframe supporting the plate cylinder and the press drive gears; wherein the improvement comprises:

a drive shaft, having a first and second end, rotationally supported by the sideframe;

a clutch gear rotationally mounted on the first end of the drive shaft and meshing with at least one press drive gear;

a drive gear secured to the second end of the drive shaft and meshing with the dampener drive gear;

a specified diameter integrally a part of the outside diameter of the drive shaft;

a stepped diameter made integrally a part the endmost portion of the first end of the drive shaft;

a clutch bearing securely attached to the clutch gear;

an axial-type shaft guide mounted in the sideframe, said axial-type shaft guide having a recessed shoulder and stepped shoulder therein;

an axial-type actuator shaft rotationally and axially supported in the axial-type shaft guide;

a pin secured normal to the axis of the axial-type actuator shaft and located on the recessed shoulder when in a first position and located on the stepped shoulder when in a second position;

a means for biasing the axial-type actuator shaft and pin for maintaining the pin in the first or second position;

an axial-type guide block rotationally mounted on the axial-type actuator shaft; and a means for transferring the axial movement of the axial-type guide block to the clutch gear;

whereby alternate positioning of the axial-type actuator shaft causing the pin to alternately move from the first position to the second position will cause the clutch bearing to be alternately located over the specified diameter and the stepped diameter.

13. The drive disengaging device of claim 12 wherein the means for transferring the axial movement of the axial-type guide block to the clutch gear comprises a fork guide rotationally mounted on the clutch gear and a fork secured to the axial-type guide block and guidingly engaging the fork guide; and further comprising at least two parallel surfaces in the axial-type guide block defining a cutout and a guide pin secured to the axial-type shaft guide and slidingly engaging the parallel surfaces of the axial-type guide block.

14. The drive disengaging device of claim 12 wherein the means for transferring the axial movement of the axial-type guide block to the clutch gear comprises an arm pivotally attached to the axial-type guide block and an arm bearing mounted to the arm, said arm bearing being also attached to the clutch gear.

15. A drive disengaging device for disengaging a seal-type continuous dampening system from the drive train of an offset lithographic printing press; the seal-type dampener including at least two rollers, two seals enclosing the ends of the inward nip of two of the rollers, and a dampener drive gear; the printing press including a plate cylinder, press drive gears and a sideframe supporting the plate cylinder and the press drive gears; wherein the improvement comprises:

a drive shaft, having a first and second end, rotationally supported by the sideframe;

a clutch gear rotationally mounted on the first end of the drive shaft and meshing with at least one press drive gear;

a drive gear secured to the second end of the drive shaft and meshing with the dampener drive gear;

a specified diameter integrally a part of the outside diameter of the drive shaft;

a stepped diameter made integrally a part the endmost portion of the first end of the drive shaft;

a clutch bearing securely attached to the clutch gear;

a rotation-type shaft guide mounted in the sideframe;

a rotation-type actuator shaft rotationally supported in the rotation-type shaft guide;

a rotation-type guide block rotationally and axially mounted on the rotation-type actuator shaft;

at least two parallel surfaces helically wound around and integrally a part of the rotation-type actuator shaft, said surfaces starting at a first position and ending at a second position;

a full dog set screw attached to the rotation-type guide block and engaging the parallel surfaces; and a means for transferring the axial movement of the rotation-type guide block to the clutch gear;

whereby alternate rotational movement of the rotation-type actuator shaft causing the full dog set screw to alternately move from the first position to the second position will cause the clutch bearing to be alternately located over the specified diameter and the stepped diameter.

16. The drive disengaging device of claim 15 wherein the means for transferring the axial movement of the rotation-type guide block to the clutch gear comprises a fork guide mounted on the clutch gear and a fork secured to the rotation-type guide block and guidingly engaging the fork guide and further comprising at least two parallel surfaces in the rotation-type guide block defining a cutout and a guide pin secured to the rotation-type shaft guide and slidingly engaging the parallel surfaces of the rotation-type guide block.

17. The drive disengaging device of claim 15 wherein the means for transferring the axial movement of the rotation-type guide block to the clutch gear comprises an arm pivotally attached to the rotation-type guide block;

an arm bearing mounted to the arm, said arm bearing being also attached to the clutch gear.

18. The drive disengaging device of claim 15 further comprising a spring plunger secured to the rotation-type guide block, said spring plunger including a spring loaded finger extending therefrom;

an on-detent and an off-detent made an integral part of the rotation-type actuator shaft and aligning with the spring plunger such that when the clutch bearing is located over the specified diameter the spring loaded finger falls into the on-detent and when the clutch bearing is located over the stepped diameter the spring loaded finger falls into the off-detent.

* * * * *